US011850618B2

(12) United States Patent
Ge et al.

(10) Patent No.: US 11,850,618 B2
(45) Date of Patent: Dec. 26, 2023

(54) NOZZLE ASSEMBLY, EJECTING DEVICE AND EJECTING METHOD

(71) Applicant: YANTAI JEREH PETROLEUM EQUIPMENT & TECHNOLOGIES CO., LTD., Shandong (CN)

(72) Inventors: Yushuai Ge, Yantai (CN); Fengwen Liu, Yantai (CN); Shiqi Li, Yantai (CN); Mingming Yu, Yantai (CN); Qingfeng Yu, Yantai (CN)

(73) Assignee: YANTAI JEREH PETROLEUM EQUIPMENT & TECHNOLOGIES CO., LTD., Yantai (CN)

( * ) Notice: Subject to any disclaimer, the term of this patent is extended or adjusted under 35 U.S.C. 154(b) by 295 days.

(21) Appl. No.: 17/254,722

(22) PCT Filed: Nov. 24, 2020

(86) PCT No.: PCT/CN2020/131067

§ 371 (c)(1),
(2) Date: Dec. 21, 2020

(87) PCT Pub. No.: WO2022/088330

PCT Pub. Date: May 5, 2022

(65) Prior Publication Data

US 2022/0314248 A1 Oct. 6, 2022

(30) Foreign Application Priority Data

Oct. 30, 2020 (CN) ..... 202011189116.6
Oct. 30, 2020 (CN) ..... 202022464585.6

(51) Int. Cl.
*B05B 5/03* (2006.01)
*B05B 5/053* (2006.01)

(52) U.S. Cl.
CPC ..... *B05B 5/03* (2013.01); *B05B 5/053* (2013.01); *B05B 5/0533* (2013.01)

(58) Field of Classification Search
CPC ..... B05B 5/03; B05B 5/053; B05B 5/0533; B05B 5/043; B05B 5/1608; B05B 7/067
See application file for complete search history.

(56) References Cited

U.S. PATENT DOCUMENTS 9,962,720 B2 * 5/2018 St. Peter ..... B05B 5/03

FOREIGN PATENT DOCUMENTS

| | | | |
|---|---|---|---|
| CN | 201510953 | U | 6/2010 |
| CN | 104826755 | A | 8/2015 |
| CN | 106061619 | A | 10/2016 |
| CN | 106414932 | A | 2/2017 |

* cited by examiner

*Primary Examiner* — Steven M Cernoch
(74) *Attorney, Agent, or Firm* — XSENSUS LLP

(57) ABSTRACT

A nozzle assembly, an ejecting device and an ejecting method are provided. The nozzle assembly includes an electrode and an insulating body portion. A first fluid channel is arranged in the insulating body portion, an opening is formed on the inner surface. A second fluid channel is arranged between the inner surface of the insulating body portion and the side surface of the electrode. An ejecting outlet is formed on the outer end surface. The second fluid channel is communicated with the first fluid channel at the opening. At least part of the second fluid channel is located between the first fluid channel and the electrode. In the first direction, the opening is located between the first end surface and the second end surface of the electrode.

20 Claims, 5 Drawing Sheets

NOZZLE ASSEMBLY, EJECTING DEVICE AND EJECTING METHOD

For all purposes, the present application claims priority of Chinese Patent Application No. 202011189116.6 and Chinese Patent Application No. 202022464585.6 which are filed on Oct. 30, 2020, the disclosure of which is incorporated herein by reference in their entirety as part of the present application.

TECHNICAL FIELD

Embodiments of the present disclosure relate to a nozzle assembly, an ejecting device and an ejecting method.

BACKGROUND

A nozzle is a key component of spraying equipment, and its performance has a great influence on spraying operation effect. At present, the common atomization methods are air-assisted atomization and hydraulic atomization. Without other assistance, hydraulic atomization has short working distance and large droplets, which is difficult to meet the needs of users. A high-pressure gas flow in the air-assisted atomization can not only atomize a liquid flow into droplets with smaller diameter, but also increase ejecting distance of the droplets. An electrostatic sprayer can charge the droplets and realize the surrounding adsorption of the droplets to an object.

SUMMARY

An embodiment of the present disclosure provides a nozzle assembly, including:

an electrode with a strip shape extending in a first direction, wherein the electrode has a first end surface and a second end surface at two opposite ends in the first direction and a side surface connecting the first end surface and the second end surface; and an insulating body portion, arranged around the electrode along a circumferential direction around the first direction, and including an outer end surface close to the first end surface and an inner surface facing the side surface of the electrode, wherein a first fluid channel configured to transfer a first fluid is arranged in the insulating body portion, an opening is formed on the inner surface of the insulating body portion by the first fluid channel, a second fluid channel configured to transfer a second fluid is arranged between the inner surface of the insulating body portion and the side surface of the electrode, an ejecting outlet is formed on the outer end surface of the insulating body portion by the second fluid channel, and the second fluid channel is communicated with the first fluid channel at the opening, at least part of the second fluid channel is located between the first fluid channel and the electrode; and in the first direction, the opening is located between the first end surface and the second end surface of the electrode.

In an example, the side surface of the electrode is a conductive surface, and at least part of the conductive surface is directly exposed to the second fluid channel.

In an example, at least part of each of the side surface and the first end surface of the electrode is provided with an insulating coating layer; and in a second direction perpendicularly intersecting the first direction, a projection of the opening on the electrode is entirely located on the insulating coating layer of the electrode.

In an example, in the first direction, a set position on the side surface is farther away from the ejecting outlet than an edge of the opening away from the ejecting outlet by at least 5 mm, and within a range from the set position on the side surface to the first end surface, the side surface of the electrode is provided with the insulating coating layer, and whole of the first end surface is provided with the insulating coating layer.

In an example, an end portion of the electrode connected with the first end surface has a cylindrical shape; and in the first direction, a length of the end portion is greater than a distance from the edge of the opening away from the ejecting outlet to the first end surface.

In an example, a diameter D1 of a projection of the end portion on a plane perpendicular to the first direction is in a range of 0.5 mm to 5 mm.

In an example, the inner surface of the insulating body portion includes a first sub-inner surface located between the opening and the ejecting outlet in the first direction and a second sub-inner surface which is on a side of the opening away from the ejecting outlet and opposite to the end portion, both the first sub-inner surface and the second sub-inner surface are cylindrical surfaces, and the first sub-inner surface, the second sub-inner surface and the end portion are coaxially arranged.

In an example, a diameter D2 of the second sub-inner surface is greater than the diameter D1 of the first end surface by 1 mm to 5 mm.

In an example, a ratio of a diameter D3 of the first sub-inner surface to the diameter D2 of the second sub-inner surface is in a range of 1 to 1.3.

In an example, in the first direction, an edge of the opening close to the ejecting outlet is no closer to the ejecting outlet than the first end surface of the electrode, and a distance between each position of the edge, close to the ejecting outlet, of the opening and the first end surface of the electrode is constant and between 0 mm and 8 mm.

In an example, in a direction from the second end surface to the first end surface, a radial size of at least part of the electrode gradually shrinks, and the at least part of the electrode is directly connected with the end portion.

In an example, the insulating body portion includes an insulating base and an insulating cover which are detachably connected with each other, the insulating base, the insulating cover and the electrode jointly define the second fluid channel, and the insulating base and the insulating cover jointly define the first fluid channel.

In an example, at least one sealing member is arranged between the insulating base and the insulating cover to prevent a fluid from the first fluid channel from leaking to the outside of the insulating body portion via a gap between the insulating base and the insulating cover.

In an example, the outer end surface of the insulating body portion is formed with a concave portion recessed toward the second end surface, the ejecting outlet is located at the bottom of the concave portion, and the first end surface of the electrode is located in the concave portion.

In an example, the first fluid channel and the second fluid channel each have an annular shape around the electrode.

In an example, the electrode, the first fluid channel and the first fluid channel are coaxially arranged.

Another embodiment of the present disclosure provides an ejecting device, including:

any one of the above described nozzle assemblies, a liquid source communicated with the first fluid channel and configured to supply a liquid as the first fluid to the first fluid channel;

a gas source communicated with the second fluid channel and configured to provide an insulating gas as the second fluid to the second fluid channel; and a power supply electrically connected to the electrode and configured to supply voltage to the electrode.

In an example, an absolute value of the voltage is less than or equal to 1,300 V.

Yet another embodiment of the present disclosure provides an ejecting method using a nozzle assembly, wherein the nozzle assembly is any one of the above described nozzle assemblies, and the method includes:

supplying a gas to the second fluid channel to form a gas flow in the second fluid channel;

supplying a liquid to the first fluid channel to form a liquid flow in the first fluid channel; and supplying a voltage of a first polarity to the electrode, so that droplets formed by meeting of the gas flow and the liquid flow are induced by the electrode and thus carry charges of a second polarity which is opposite to the first polarity.

In an example, the liquid flow is introduced into the first fluid channel and reaches the opening in a state where the gas flow is introduced into the second fluid channel.

BRIEF DESCRIPTION OF THE DRAWINGS

In order to explain the embodiments of the present disclosure or the technical solutions in the prior art more clearly, the drawings used in the embodiments or the description of the prior art will be briefly introduced below. Obviously, the drawings in the following description are only some embodiments of this disclosure, and other embodiments can be obtained by those ordinarily skilled in the art according to these drawings without inventive work.

DETAILED DESCRIPTION

Figure 1:
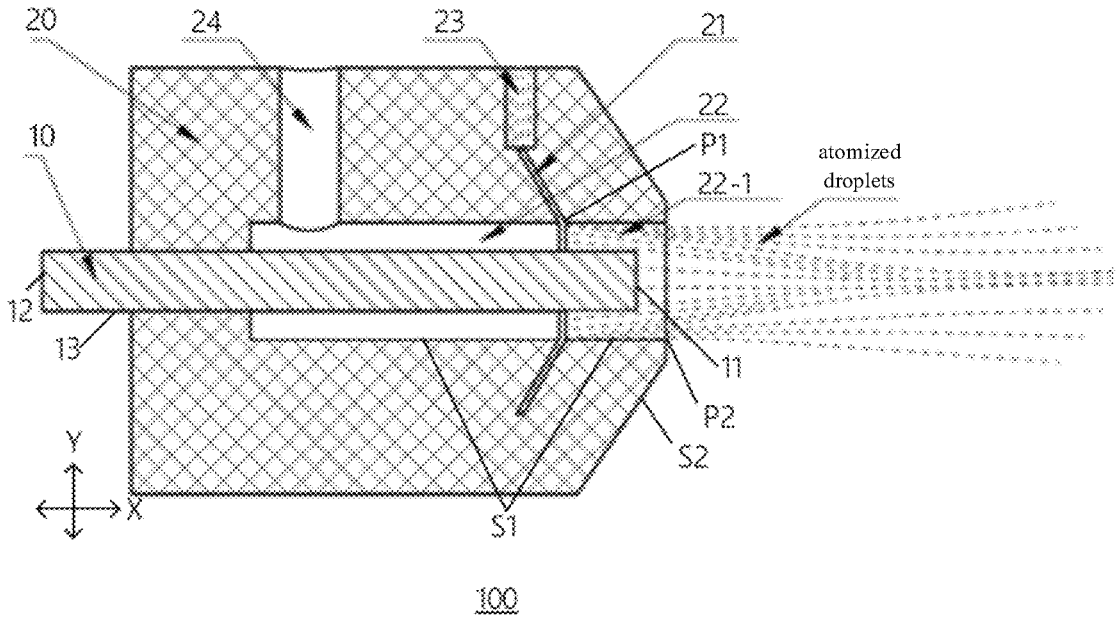
FIG. 1 is a schematic cross-sectional diagram of a nozzle assembly provided by an embodiment of the present disclosure.

In order to make objects, technical details and advantages of the embodiments of the present disclosure apparent, the technical solutions of the embodiment will be described in a clearly and fully understandable way in connection with the drawings related to the embodiments of the present disclosure. It is obvious that the described embodiments are just a part but not all of the embodiments of the present disclosure. Based on the described embodiments herein, those ordinarily skilled in the art can obtain other embodiment(s), without any inventive work, which should be within the scope of the present disclosure.

Unless otherwise specified, the technical terms or scientific terms used in the present disclosure should be of general meaning as understood by those ordinarily skilled in the art. In the disclosure, words such as "first", "second" and the like do not denote any order, quantity, or importance, but rather are used for distinguishing different components. Similarly, words such as "include" or "comprise" and the like denote that elements or objects appearing before the words of "include" or "comprise" cover the elements or the objects enumerated after the words of "include" or "comprise" or equivalents thereof, not exclusive of other elements or objects. Words such as "connected" or "connecting" and the like are not limited to physical or mechanical connections, but may include electrical connection, either direct or indirect. Words such as "up", "down", "left", "right" and the like are only used for expressing relative positional relationship, when the absolute position of the described object is changed, the relative positional relationship may also be correspondingly changed.

The inventor(s) of the present disclosure noticed that the common electrostatic atomization nozzles at home and abroad have many parts, complex structure, high machining accuracy and poor consistency of charging effect.

Some embodiments of the present disclosure provide a nozzle assembly including: an electrode and an insulating body portion. The electrode has a strip shape extending in a first direction. The electrode has a first end surface and a second end surface at two opposite ends in a first direction, and a side surface connecting the first end surface and the second end surface. The insulating body portion is arranged around the electrode in a circumferential direction around the first direction, and includes an outer end surface close to the first end surface and an inner surface facing the side surface of the electrode. A first fluid channel configured to transfer a first fluid is arranged in the insulating body portion. An opening is formed on the inner surface of the insulating body portion by the first fluid channel. A second fluid channel configured to transfer a second fluid is arranged between the inner surface of the insulating body portion and the side surface of the electrode. An ejecting outlet is formed on the outer end surface of the insulating body portion by the second fluid channel. The second fluid channel is communicated with the first fluid channel at the opening. At least part of the second fluid channel is located between the first fluid channel and the electrode. In the first direction, the opening is located between the first end surface and the second end surface of the electrode.

Other embodiments of the present disclosure provide an ejecting device, including: the nozzle assembly above, a gas source, a liquid source and a power supply. The liquid source is communicated with the first fluid channel and configured to provide a liquid as the first fluid to the first fluid channel. The gas source is communicated with the second fluid channel and configured to provide a gas as the second fluid to the second fluid channel. The power supply is electrically connected to the electrode and configured to supply voltage to the electrode.

Still other embodiments of the present disclosure provide an ejecting method using the above-mentioned nozzle assembly, including: supplying a gas to a second fluid channel to form a gas flow in the second fluid channel; supplying a liquid to a first fluid channel to form a liquid flow in the first fluid channel; and supplying voltage of a first polarity to an electrode, so that droplets formed by meeting of the gas flow and the liquid flow are induced by the electrode and thus carry charges of a second polarity which is opposite to the first polarity.

In the nozzle assembly, the ejecting device and the ejecting method provided by the embodiments of the present disclosure, by appropriately arranging the electrode, a gas flow channel and a liquid flow channel, the electrode is isolated from the liquid to be kept dry all the time, so that stable atomization effect and charging effect are obtained. In addition, the nozzle assembly and the ejecting device are simple in structure and stable in performance.

FIG. 1 is a schematic cross-sectional diagram of a nozzle assembly provided by an embodiment of the present disclosure.

Referring to FIG. 1, a nozzle assembly 100 provided by an embodiment of the present disclosure includes: an electrode 10 and an insulating body portion 20. The electrode 10 has a strip shape extending in a first direction X. Herein, the strip-shaped electrode 10 means that the length of the electrode 10 in the first direction X is at least three times as large as its length in the second direction Y. The second direction Y can be any direction perpendicularly intersecting the first direction X.

For example, the electrode 10 has a cylindrical shape. The first direction X is, for example, an axial direction of the electrode 10 and the second direction Y is a radial direction of the electrode 10. Even if the first electrode 10 is not in a cylindrical shape, the first direction X and the second direction Y take the meanings of axial and radial directions of the cylindrical electrode 2.

The electrode 10 is for example formed entirely of conductive materials such as metal and metal alloys.

The electrode 10 is mounted on the insulating body portion 20, for example.

Of course, the embodiment of the present disclosure does not limit the specific shape of the electrode 10; in another example, the electrode 10 can also have a prismatic shape, a pyramid shape, a needle shape or any combination thereof.

The electrode 10 has a first end surface 11 and a second end surface 12 at two opposite ends in a first direction X, and a side surface 13 connecting the first end surface 11 and the second end surface 12. The side surface 13 is a curved surface extending in a circumferential direction around the first direction X. For example, both the first end surface 11 and the second end surface 12 are circular planar surfaces perpendicular to the first direction X. The side surface 13 is a cylindrical surface. However, the embodiments of the present disclosure do not limit the shapes and inclination angles of the first end surface 11 and the second end surface 12. In another example, the first end surface 11 can be a tapered surface or a hemispherical surface. In yet another embodiment, the first end surface 11 can be a planar surface at an acute angle with the first direction X. Compared with the case where the first end surface 11 is a non-planar surface, the planar first end surface 11 is more convenient to machine and is not prone to damage due to deformation.

The insulating body portion 20 is arranged around the electrode 10 in a circumferential direction around the first direction X, and includes an outer end surface S2 close to the first end surface 11 and an inner surface S1 facing the side surface 13 of the electrode 10. The inner surface S1 is another curved surface extending in the circumferential direction around the first direction X. For example, the inner surface S1 is a cylindrical surface.

A first fluid channel 21 configured to transfer a first fluid is arranged in the insulating body portion 20. The first fluid channel 21 is formed with an opening P1 on the inner surface S1 of the insulating body portion 20. The first fluid is, for example, liquid. The liquid can be water, liquid prepared from inorganic drugs and water, or liquid prepared from organic drugs and water.

For example, a first interface channel (i.e., a liquid inlet channel) 23 communicated with the first fluid channel 21 is also arranged in the insulating body portion 20, and the first interface channel 23 is configured to communicate the first fluid channel 21 with an external liquid source.

It can be understood that because the opening P1 is located in the inner surface S1 of the insulating body portion 20, and the inner surface S1 of the insulating body portion 20 and the side surface 13 of the electrode 10 are spaced apart from each other, the formed opening P1 is not in contact with the electrode 10. The opening P1 is the portion of the first fluid channel 21 closest to electrode 10.

For example, the first fluid channel 21 is an annular channel; the opening P1 has a circular shape surrounding the electrode 10.

A second fluid channel 22 configured to transfer a second fluid is arranged between the inner surface S1 of the insulating body portion 20 and the side surface 13 of the electrode 10, and the second fluid channel 22 is formed with an ejecting outlet P2 at the outer end surface S2 of the insulating body portion 20. The second fluid is, for example, an insulating gas. More specifically, the second fluid is compressed air. The inner surface S1 and the outer end surface S2 of the insulating body portion 20 are connected to each other at the ejecting outlet P2.

The first end surface 11 is closer to the ejecting outlet P2 than the second end surface 12.

The second fluid channel 22 is communicated with the first fluid channel 21 at the opening P1.

The second fluid channel 22 is closer to the electrode 10 than the first fluid channel 21. At least part of the second fluid channel 22 is located between the first fluid channel 21 and the electrode 10.

In the first direction X, the opening P1 is located between the first end surface 11 and the second end surface 12 of the electrode 10.

For example, a second interface channel (i.e., a gas inlet channel) 24 communicated with the second fluid channel 22 is also arranged in the insulating body portion 20. The second interface channel 24 is configured to communicate the second fluid channel 22 with an external gas source.

For example, the second fluid channel 22 is an annular channel. The ejecting outlet P2 has a circular shape.

For example, the electrode 10, the first fluid channel 21 and the second fluid channel 22 are arranged coaxially; that is, the symmetry axis of the electrode 10, the symmetry axis of the first fluid channel 21 and the symmetry axis of the second fluid channel 22 coincide with one another.

Herein, the shapes of the first fluid channel 21 and the second fluid channel 22 are not limited. In another example, the first fluid channel 21 and the second fluid channel 22 have, for example, a semi-annular shape or a strip shape; the first fluid channel 21 and the second fluid channel 22 can both be located only on the same side of the symmetry axis of the electrode 10, such as the lower side of the symmetry axis of the electrode 10 in FIG. 1.

The first end surface 11, the second end surface 12 and the side surface 13 of the electrode 10 are all conductive surfaces.

For example, at least part of the conductive side surface 13 is directly exposed to the first fluid channel 21.

Referring to FIG. 1, the conductive first end surface 11 is all directly exposed to the second fluid channel 22; a portion of the conductive side surface 13 close to the first end surface 11 is directly exposed to the second fluid channel 22; a portion of the conductive side surface 13 close to the second end surface 12 is all exposed to the outside of the insulating body portion 20; and the remaining portion of the conductive side surface 13 is covered by the insulating body portion 20.

In another example, all the conductive first end surface 11, second end surface 12 and side surface 13 of the electrode 10 are provided with an insulating coating layer.

In yet another example, the entire conductive first end surface 11 and a portion of the conductive side surface 13 of the electrode 10 are provided with an insulating coating layer.

In the embodiment of the present disclosure, the droplets close to the electrode 10 are charged with the opposite polarity due to electrostatic induction of the electrode 10, instead of carrying charges by contacting the droplets with the electrode, so it is not limited whether the conductive surfaces of the electrode 10 are provided with insulating coating layer(s). The conductive surface portion of the electrode 10 provided with the insulating coating layer can be better kept in a dry state to provide a better charging effect.

Figure 2:
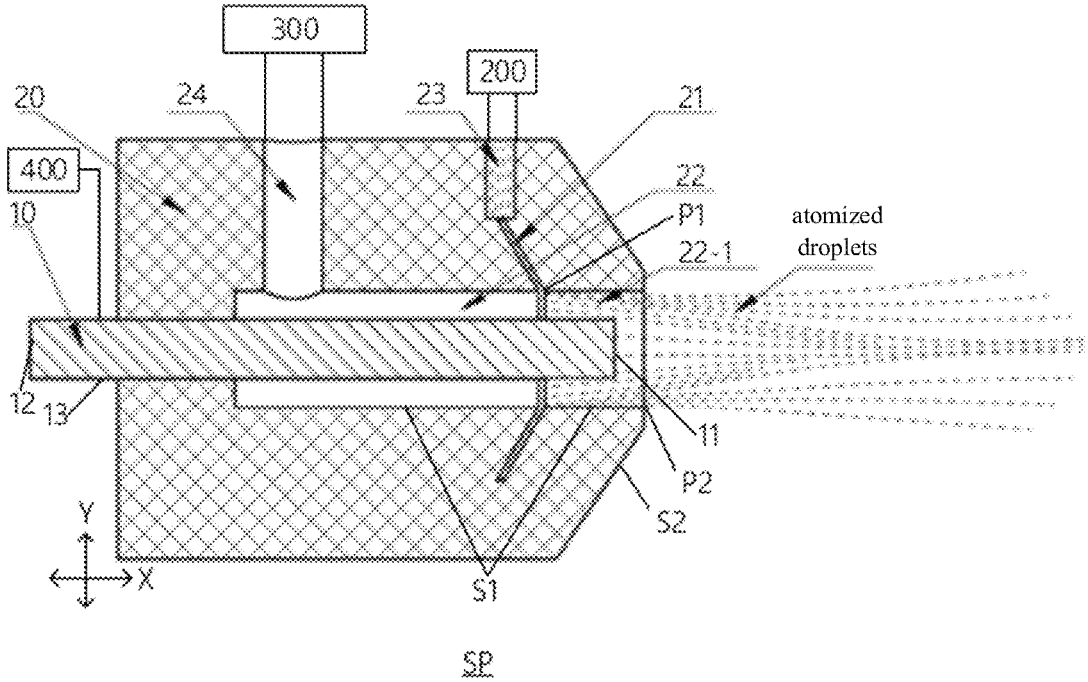
FIG. 2 is a schematic structure diagram of an ejecting device provided by an embodiment of the present disclosure.

FIG. 2 is a schematic structure diagram of an ejecting device provided by an embodiment of the present disclosure.

Referring to FIG. 2, the ejecting device SP includes the nozzle assembly 100 shown in FIG. 1, a liquid source 200, a gas source 300 and a power supply 400.

The liquid source 200 is communicated with the first fluid channel 21 through the first interface channel 23 and configured to provide liquid as the first fluid to the first fluid channel 21. For example, the liquid source 200 is a liquid pump configured to provide a stable liquid flow to the first fluid channel 21.

The gas source 300 is communicated with the second fluid channel 22 through the second interface channel 24 and configured to provide insulating gas as the second fluid to the second fluid channel 22. For example, the insulating gas is compressed air.

The power supply 400 is electrically connected to the electrode 10 and configured to supply voltage to the electrode 10. For example, an absolute value of the voltage is less than or equal to 1,300 V. For example, the power supply 400 is a high voltage electrostatic generator.

Figure 3:
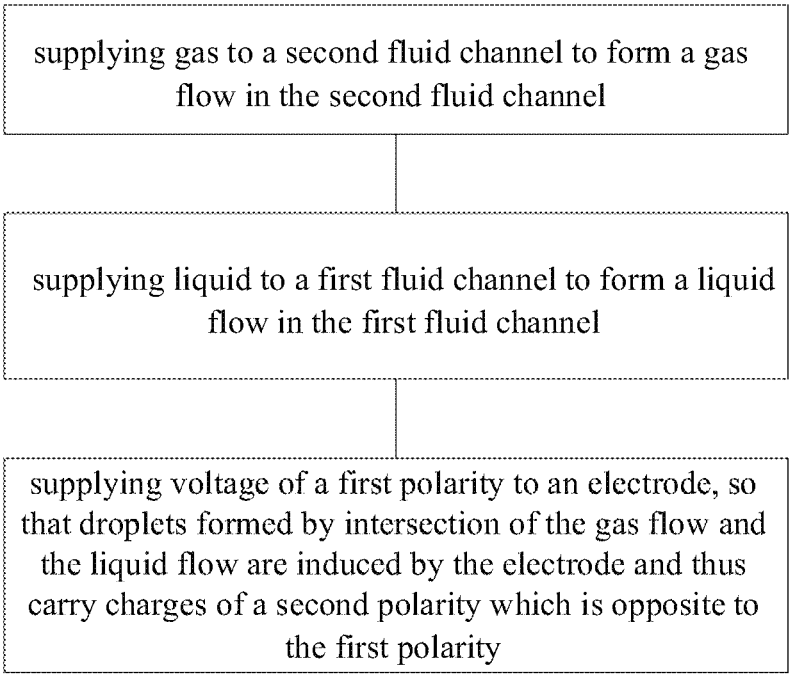
FIG. 3 is a schematic diagram of an ejecting method using a nozzle assembly provided by an embodiment of the present disclosure.

FIG. 3 is a schematic diagram of a method for ejecting charged spray using a nozzle assembly provided by an embodiment of the present disclosure.

Next, referring to FIGS. 1-3, the method and principle of ejecting the charged spray using the nozzle assembly provided by the embodiment of the present disclosure will be described.

The method for ejecting charged spray using the nozzle assembly provided by an embodiment of the present disclosure includes:

supplying gas to a second fluid channel to form a gas flow in the second fluid channel;

supplying liquid to a first fluid channel to form a liquid flow in the first fluid channel; and supplying voltage of a first polarity to an electrode, so that droplets formed by intersection of the gas flow and the liquid flow are induced by the electrode and thus carry charges of a second polarity which is opposite to the first polarity.

Referring to FIGS. 1-3, the process principle of ejecting the charged spray using the nozzle assembly provided by the embodiment of the present disclosure is described as follows.

External compressed air enters the second fluid channel 22 through the second interface channel 24 to generate a high-speed gas flow in the second fluid channel 22; the high-speed gas flow in the second fluid channel 22 surrounds and covers the electrode 10 and moves in the direction towards the ejecting outlet P2. Herein, the high-speed gas flow can serve as an insulating layer covering the side surface 13 of the electrode 10.

The externally pumped liquid enters the first fluid channel 21 through the first interface channel 23 to generate a liquid flow in the first fluid channel 21; the liquid flow uniformly flows in the direction towards the opening P1, in the first fluid channel 21; and when the high-speed gas flow meets the liquid flowing out of the opening P1, it will instantly atomize the liquid into a large number of droplets. In the portion 22-1 of the second fluid channel 22 close to the ejecting outlet P2, the high-speed gas flow separates the droplets from the electrode, and keeps the electrode 10 dry all the time. The dry electrode 10 with the voltage of the first polarity allows the droplets to carry charges of a second polarity opposite to the first polarity through electrostatic induction; and the charged droplets are ejected outward at high speed along with the high-speed gas flow and can be adsorbed around an object they meet.

The nozzle assembly provided by the embodiment of the present disclosure is an efficient air-assisted electrostatic nozzle assembly.

It can be understood that in the above method, the order of the respective steps is not limited. In order to keep the dry state of the electrode 10, preferably, the liquid flow introduced into the first fluid channel reaches the opening P1 in the case that the gas flow is introduced into the second fluid channel. However, the method provided by the embodiment of the present disclosure is not limited thereto.

For example, in another embodiment, when the flow velocity of the liquid flow in the first fluid channel 21 is slow and/or a portion of the second fluid channel 22 between the opening P1 and the ejecting outlet P2 has a larger width in the second direction and/or the first fluid channel 21 is only located on the same side of the axial direction of the electrode 10, even if the liquid flow in the first fluid channel reaches the opening P1 when the high-speed gas flow is not introduced into the second fluid channel, the electrode 10 will not be wetted by direct contact with the liquid flowing out of the opening P1.

In the nozzle assembly, the ejecting device including the nozzle assembly and the method for ejecting charged spray using the nozzle assembly provided by the embodiments of the present disclosure, high-speed gas flow covers the electrode in the second fluid channel (gas flow channel) and flows outward, separating the liquid flowing out from the first fluid channel (liquid channel) from the electrode, and atomizing the liquid entering the nozzle at the same time. In this process, the liquid and the droplets don't contact with the electrode all along, thus ensuring the electrode to be dry. In the atomization process, charges with opposite polarity to the electrode are induced on atomized droplets and ejected outward along with the high-speed gas flow. The ejected charged droplets are fine and uniform and are uniformly attached to the surface of the object under the action of electrostatic force, thus improving the utilization rate of a liquid medicine and the attachment effect of the droplets.

In a technique, an electrode is directly exposed to a liquid channel, and a liquid flow flows directly contacts with the conductive surface of the electrode. In this case, in order to atomize and charge the liquid, it is generally necessary to supply voltage with an absolute value of not less than 20,000 V to the electrode to effectively charge the droplets atomized from the liquid flow.

In the technical solution of the embodiment of the present disclosure, the high-speed gas flow which is in direct contact with the conductive surfaces of the electrode and covers the conductive surfaces can be used as an insulating layer to effectively isolate the liquid flow from the electrode, so that the atomized droplets can be effectively charged under the condition that the absolute value of the voltage supplied to the electrode can be significantly reduced (for example, less than or equal to 1,300 V). In addition, due to the isolation of the high-speed gas flow, the atomized droplets are basically not in contact with the electrode, the charges carried by the atomized droplets can be stably retained thereon, enabling high charging efficiency of the atomized droplets.

Figure 4:
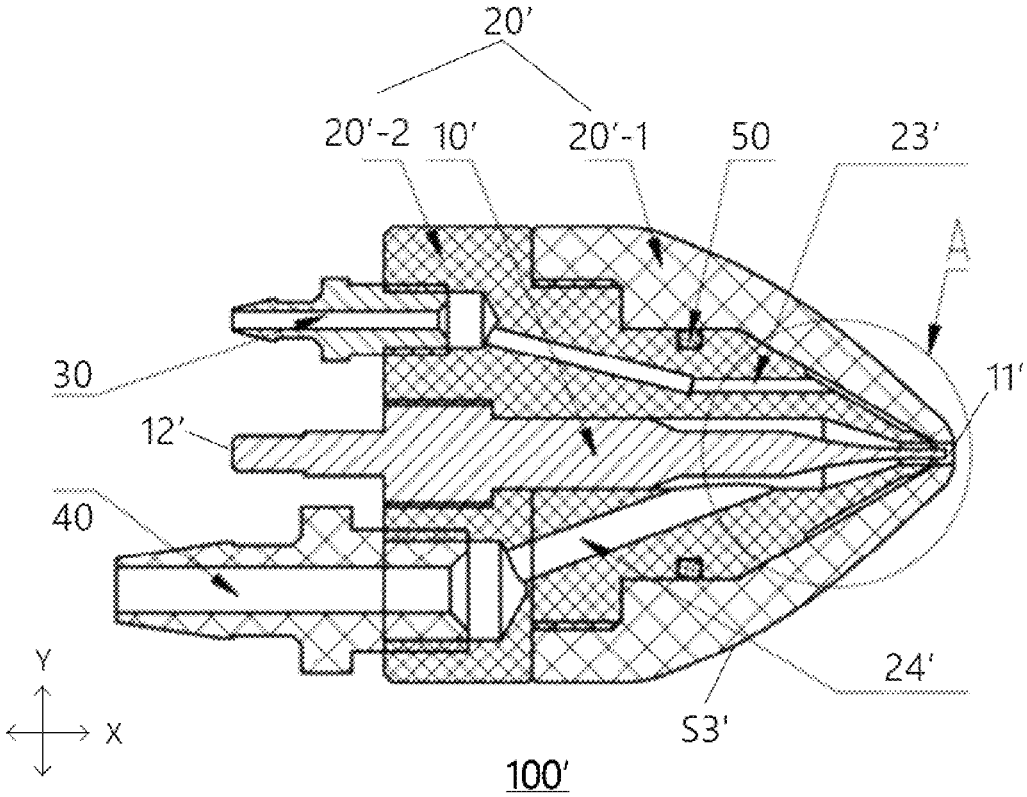
FIG. 4 is a schematic cross-sectional diagram of a nozzle assembly provided by another embodiment of the present disclosure.
Figure 5:
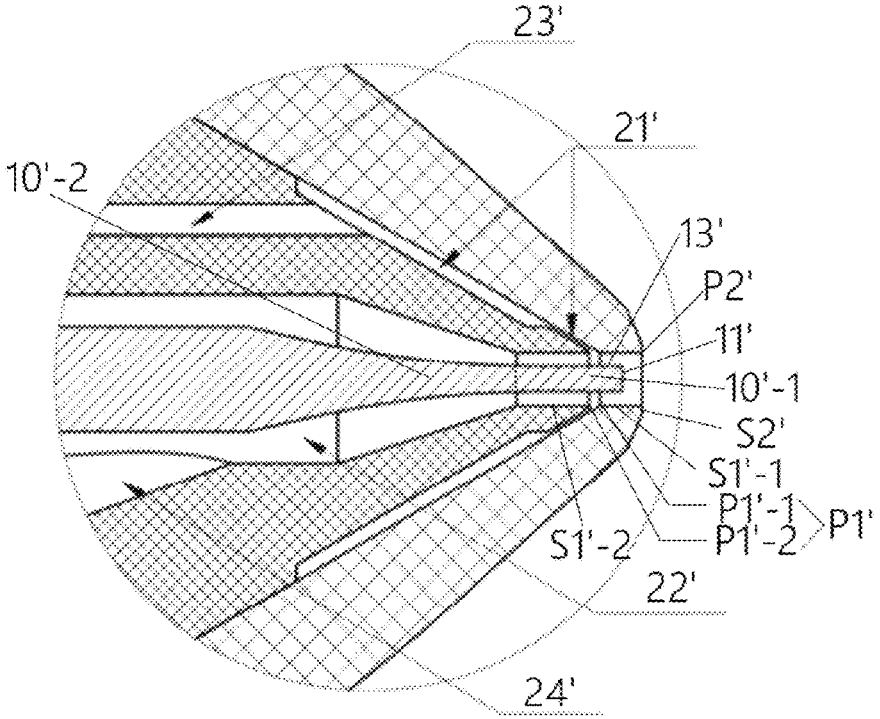
FIG. 5 is an enlarged view of an area A in FIG. 4.

FIG. 4 is a schematic cross-sectional diagram of the nozzle assembly provided by another embodiment of the present disclosure. FIG. 5 is an enlarged view of the area A in FIG. 4.

Referring to FIGS. 4 and 5, the nozzle assembly 100' provided by another embodiment of the present disclosure includes: an electrode 10' and an insulating body portion 20'. The main difference between the nozzle assembly 100' shown in FIG. 4 and the nozzle assembly 100 shown in FIG. 1 is that the insulating body portion 20' includes an insulating cover 20'-1 and an insulating base 20'-2 which are detachably connected with each other; the insulating base 20'-2 and the insulating cover 20'-1 jointly define a first fluid channel 21; and the insulating base 20'-2, the insulating cover 20'-1 and the electrode 10' jointly define a second fluid channel 22'. The following mainly describes the features of the nozzle assembly 100' different from those of the nozzle assembly 100, and features of members not described are substantially the same as corresponding features of members with the same names or corresponding reference numbers of the nozzle assembly 100'. Reference signs having the same letter or number are corresponding reference signs.

The electrode 10' are connected with the insulating body portion 20' by threads, for example. The insulating base 20'-2 and the insulating cover 20'-1 are connected by threads, for example.

The electrode 10' has a symmetry axis in the X direction. The X direction is the axial direction of the electrode 10'.

The insulating base 20'-2 and the insulating cover 20'-1 are cone-like at the portion close to an ejecting outlet P2'.

An outer end surface S2' of the insulating base 20'-2 serves as an outer end surface of the insulating body portion 20' and an outer end surface of the entire nozzle assembly 100'.

An inner surface S1' of the insulating body portion 20' includes a first sub-inner surface S1'-1 and a second sub-inner surface S1'-2. The first sub-inner surface S1'-1 is located between the ejecting outlet P2' and an edge P1'-1 of an opening P1' close to the ejecting outlet P2'. The second sub-inner surface S1'-2 is located on a side of an edge P1'-2 of the opening P1' away from the ejecting outlet P2'; the edge P1'-2 of the opening P1' is away from the ejecting outlet P2'.

Herein, the first sub-inner surface S1'-1 and the second sub-inner surface S1'-2 of the insulating body portion 20' are both cylindrical surfaces, for example. The ejecting outlet P2' is, for example, a circular opening.

An end portion 10'-1 of the electrode 10' directly connected to the first end surface 11' has a cylindrical shape. For example, referring to FIG. 5, the end portion 10'-1 is shown as a portion of the electrode between the dashed line and the first end surface 11'.

In the first direction X, the length of the end portion 10'-1 is greater than the distance from the edge P1'-2 of the opening P1' away from the ejecting outlet P2' to the first end surface 11'.

The first sub-inner surface S1'-1 and the second sub-inner surface S1'-2 of the insulating body portion 20' are both opposite to the cylindrical end portion 10'-1 of the electrode 10'.

The first sub-inner surface S1'-1, the second sub-inner surface S1'-2 and the cylindrical end portion 10'-1 are arranged coaxially. That is, the symmetry axis of the first sub-inner surface S1'-1, the symmetry axis of the second sub-inner surface S1'-2 and the symmetry axis of the cylindrical end portion 10'-1 coincide with one another.

Referring to FIG. 5, the radial size of at least part of the electrode 10' (for example, a portion 10'-2) gradually shrinks in the direction from a second end surface 12' to the first end surface 11'. That is, the size (e.g., cross-sectional diameter, cross-sectional area) of at least part of the electrode 10' in a cross section that perpendicularly intersects the axial direction (X direction) thereof decreases as the cross section approaches the first end surface 11'.

For example, referring to FIG. 5, the portion 10'-2 of the electrode 10' is directly connected with the end portion 10'-1.

At least one sealing member 50 is arranged between the insulating base 20'-2 and the insulating cover 20'-1 to prevent the fluid from the first fluid channel 21 from leaking to the outside of the insulating body portion via a gap between the insulating base 20'-2 and the insulating cover 20'-1.

The sealing member 50 is, for example, an insulating O-shaped ring.

A first joint 30 is arranged at an end of a first interface channel 23' opposite to the first fluid channel 21', and configured to communicate a corresponding liquid source with the first interface channel 23'.

A first joint 40 is arranged at an end of a second interface channel 24' opposite to the second fluid channel 22', and configured to communicate a corresponding gas source with the second interface channel 24'.

In the nozzle assembly 100 shown in FIG. 1 and the nozzle assembly 100' shown in FIG. 4, the electrode 10/10' is located on an inner side of the ejecting outlet P2/P2'(that is, a side of the ejecting outlet P2/P2' close to the opening P1/P1'); and the ejecting outlet P2/P2' is on the outer end surface S2/S2' of the insulating body portion 20/20'. Herein, the outer end surface S2/S2' of the insulating body portion 20/20' is the outer end surface of the nozzle assembly 100/100'. That is, the electrode 10/10' are entirely located inside the insulating body portion 20/20', and no portion of the electrode 10/10' is exposed outside the insulating body portion 20/20'. In this way, the electrode can be effectively protected from being polluted and damaged by an external environment.

In the nozzle assembly 100' shown in FIG. 4, the insulating base 20'-2 and the insulating cover 20'-1 are detachably connected, and jointly define a channel configured for transferring liquid. Therefore, if it is necessary to thoroughly clean the liquid channel and replace the liquid transferred therein, it is only needed to detach the outermost insulating cover of the nozzle assembly from the insulating base, which is simple and efficient to operate.

Figure 6:
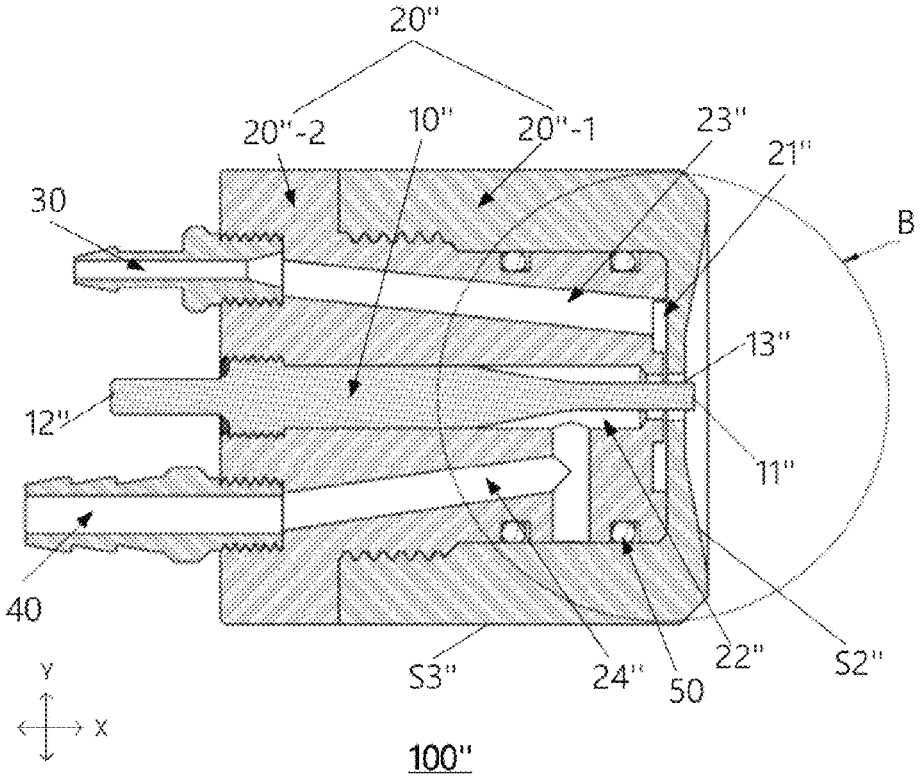
FIG. 6 is a schematic cross-sectional diagram of a nozzle assembly provided by yet another embodiment of the present disclosure.
Figure 7:
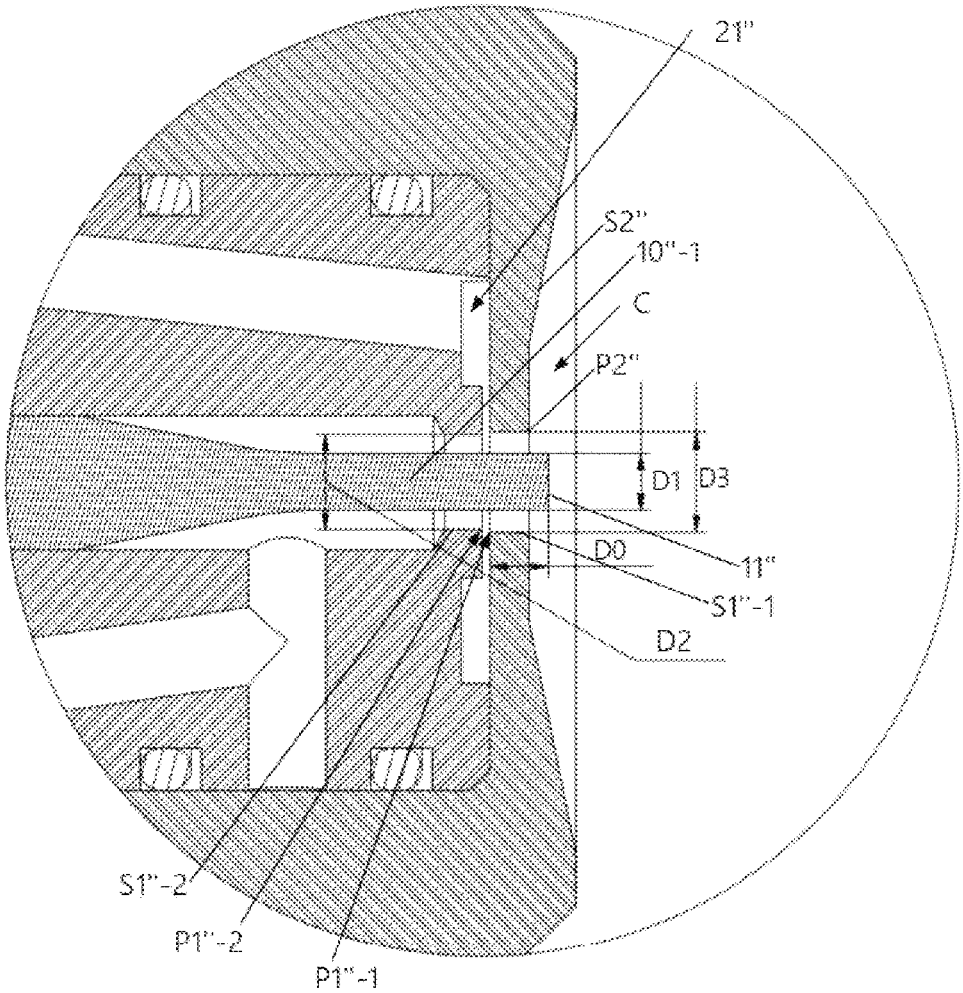
FIG. 7 is an enlarged view of an area B in FIG. 6.

FIG. 6 is a schematic cross-sectional diagram of a nozzle assembly provided by yet another embodiment of the present disclosure. FIG. 7 is an enlarged view of an area B in FIG. 6.

Referring to FIGS. 6 and 7, the nozzle assembly 100" provided by yet another embodiment of the present disclosure includes: an electrode 10" and an insulating body portion 20". The main differences between the nozzle assembly 100" shown in FIG. 6 and the nozzle assembly 100' shown in FIG. 4 are the shape of the insulating body portion 20" and the relative positional relationship between an end surface 11" of the electrode 10" and an ejecting outlet. The following mainly describes the features of the nozzle assembly 100" which are different from those of the nozzle assembly 100', and the features of members not described are substantially the same as the corresponding features of the members with the same name or corresponding reference numbers of the nozzle assemblies 100" and 100. Reference signs having the same letter or number are corresponding reference signs.

The nozzle assembly 100" includes an insulating cover 20"-1 and an insulating base 20"-2 which are detachably connected with each other. The insulating base 20"-2 and the insulating cover 20"-1 jointly define a first fluid channel 21"; and the insulating base 20"-2, the insulating cover 20"-1 and the electrode 10" jointly define a second fluid channel 22".

In FIG. 6, the insulating base 20"-2 providing the main outer contour of the nozzle assembly 100" has an outer side surface S3" which is substantially cylindrical and an outer end surface S2" connected to the outer side surface S3". Compared with the case where the side surface S3' and the outer end surface S2' of the insulating base 20'-2 of the nozzle assembly 100" shown in FIG. 4 are substantially conical, the layout space of the first fluid channel 21" and the second fluid channel 22" in the insulating base 20"-2 of the nozzle assembly 100" is larger, and the outer end surface S2" is also significantly increased.

Referring to FIG. 6, the electrode 10" includes a cylindrical end portion 10"-1 directly connected to a first end surface 11". The end portion 10"-1 protrudes out of the insulating base 20"-2 from the ejecting outlet P2". That is, the first end surface 11" of the electrode 10" (i.e., the first end surface 11" of the end portion 10"-1) is located outside the ejecting outlet P2" (i.e., a side away from the opening P1" of the ejecting outlet P2"). Compared to the case where the first end surface 11" of the electrode 10" is located on the inner side of the ejecting outlet P2" (i.e., a side of the ejecting outlet P2" close to the opening P1"), the first end surface 11" of the electrode 10" being located on the outer side of the ejecting outlet P2", is equivalent to prolonging the effective length of close-range electrostatic induction between droplets and the charged electrode, thus effectively improving the electrostatic charge rate of the droplets.

A concave portion C is formed on the outer end surface S2" of the insulating cover 20"-1 (i.e., the outer end surface S2" of the insulating body portion 20"); and the ejecting outlet P2" is located at the bottom of the concave portion C. The first end surface 11" of the end portion 10"-1 of the electrode 10" protruding out of the insulating base 20"-2 from the ejecting outlet P2" is located in the concave portion C, that is, in the first direction X, the first end surface 11" of the end portion 10"-1 is closer to the ejecting outlet P2" than the edge of the outer end surface S2" of the insulating cover 20"-1 which is farthest from the ejecting outlet P2". Therefore, the concave portion C can effectively reduce the probability that the end portion 10"-1 of the electrode 10" is damaged by external objects.

For example, the diameter D1 of the end portion 10"-1 of the electrode 10" is in a range of 0.5 mm to 5 mm. That is, the diameter D1 of a projection of the end portion 10"-1 on a plane perpendicular to the first direction X is in the range of 0.5 mm to 5 mm; therefore, it is convenient for machining, energy consumption is reduced, and the charging effect is good.

It is difficult to machine an electrode (slender shaft) with a diameter less than 0.5 mm; using an electrode with a diameter greater than 5 mm, a relatively high ventilatory capacity is required for atomization of droplets, and a large amount of compressed air is required to produce the same atomization effect, leading to high energy consumption, large equipment and diseconomy. Referring to FIGS. 6 and 7, the inner surface S1" of the insulating body portion 20" includes a first sub-inner surface S1"-1 and a second sub-inner surface S1"-2. The first sub-inner surface S1"-1 is located between the ejecting outlet P2" and an edge P1"-1 of an opening P1" close to the ejecting outlet P2". The second sub-inner surface S1"-2 is located on a side of an edge P1"-2 of the opening P1" away from the ejecting outlet P2"; and the edge P1"-2 of the opening P1" is away from ejecting outlet P2".

Herein, the first sub-inner surface S1'-1 and the second sub-inner surface S1'-2 of the insulating body portion 20" are both cylindrical surfaces, for example. The ejecting outlet P2" is, for example, a circular opening.

The first sub-inner surface S1"-1 and the second sub-inner surface S1"-2 of the insulating body portion 20" are both opposite to the cylindrical end portion 10"-1 of the electrode 10".

The first sub-inner surface S1"-1, the second sub-inner surface S1"-2 and the cylindrical end portion 10"-1 are arranged coaxially. That is, the symmetry axis of the first sub-inner surface S1"-1, the symmetry axis of the second sub-inner surface S1"-2 and the symmetry axis of the cylindrical end portion 10"-1 coincide with one another.

For example, a diameter D2 of the second sub-inner surface is greater than a diameter D1 of the first end surface by 1 mm to 5 mm. In this way, a better atomization effect can be obtained with a more economical ventilatory capacity.

For example, a ratio of a diameter D3 of the first sub-inner surface S1"-1 to the diameter D2 of the second sub-inner surface S1'-2 is in a range of 1 to 1.3. That is, the diameter D3 of the first sub-inner surface S1"-1 is greater than or equal to the diameter D2 of the second sub-inner surface S1"-2, and preferably the diameter D3 of the first sub-inner surface S1"-1 does not exceed 1.3 times of the diameter D2 of the second sub-inner surface S1"-2.

Preferably, the diameter D3 of the first sub-inner surface S1"-1 is greater than the diameter D2 of the second sub-inner surface S1"-2. In this case, the droplets can be emitted from the second fluid channel 22" stably and efficiently.

For example, referring to FIG. 7, in the first direction X, the edge P1"-1 of the opening P1" close to the ejecting outlet P2" is no closer to the ejecting outlet P2" than the first end surface 11" of the electrode 10"; and a distance DO between each position of the edge P1"-1 of the opening P1" close to the ejecting outlet P2" and the first end surface 11" of the electrode 10" is constant and between 0 mm and 8 mm. In the first direction X, the first end surface 11" of the electrode 10" is at least flush with the edge P1"-1 of the opening P1" close to the ejecting outlet P2"; or the first end surface 11" of the electrode 10" is located on the side of the edge P1"-1 of the opening P1" close to the ejecting outlet P2", the edge P1"-1 of the opening P1" is close to the ejecting outlet P2". This can not only make the droplets atomized at the opening P1" be charged effectively, but also keep the droplets ejected with high dispersion rate and uniformity.

Although in FIGS. 4 and 5, in the first direction X, the first end surface 11" of the electrode 10" is located on the side of the ejecting outlet P2" close to the opening P1" (i.e., the electrode 10" is located inside the insulating body portion 20"), embodiment of the present disclosure is not limited thereto. In another example, in the first direction X, the first end surface 11" of the electrode 10" is located on the side of the ejecting outlet P2" away from the opening P1" (i.e., the electrode 10" extends out of the insulating body portion 20"). Compared with the case where the electrode 10" is located inside the insulating body portion 20", the case that the electrode 10" extends out of the insulating body portion 20" is more conducive to charging the droplets.

However, if the electrode 10" extends out of the insulating body portion 20" for too long, it will absorb droplets with different charges, which in turn reduce the charges of the droplets. Therefore, a better charging effect can be obtained if the distance D0 between each position of the edge P1"-1 of the opening P1" close to the ejecting outlet P2" and the first end surface 11" of the electrode 10" is constant and between 0 mm and 8 mm.

Figure 8:
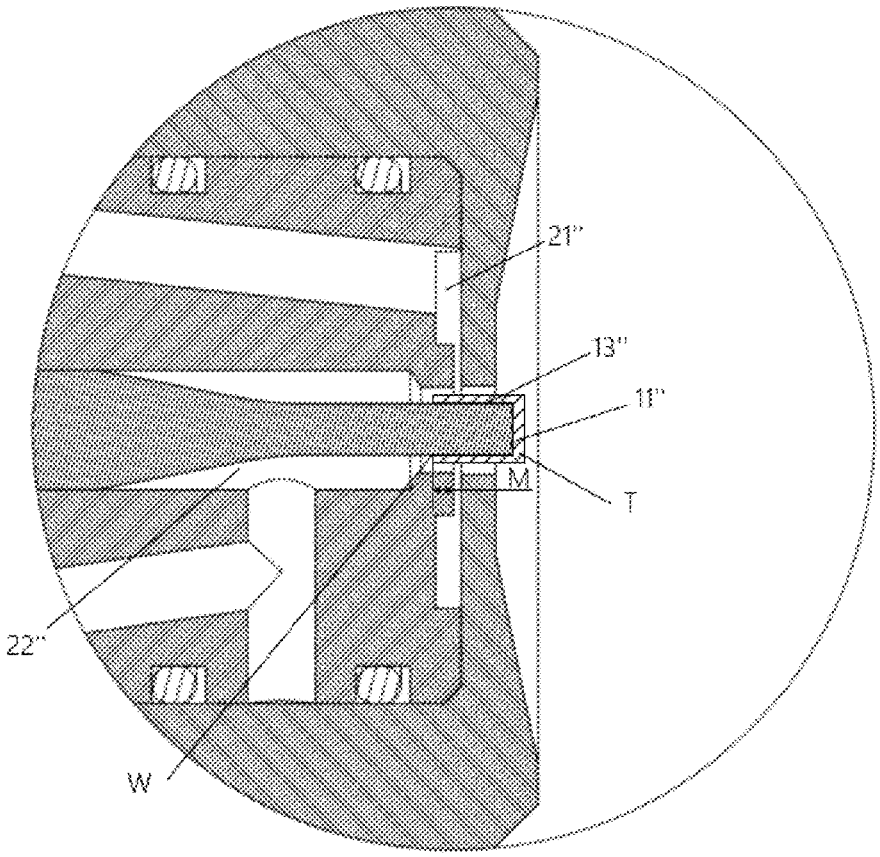
FIG. 8 is a schematic cross-sectional diagram of another example of a nozzle assembly provided by yet another embodiment of the present disclosure.

Referring to FIG. 8, at least part of each of the side surface 13" and the first end surface 11" of the electrode 10" is provided with an insulating coating layer T.

In a second direction perpendicularly intersecting the first direction (i.e., the radial direction of the electrode 10"), the projection of the opening P1" on the electrode 10" is entirely located on the insulating coating layer T. In this way, the insulating property between the droplets and the electrode can be improved.

Further, referring to FIG. 8, in the first direction X (i.e., in the axial direction of the electrode 10"), a set position W on the side surface 13" of the electrode 10" is farther away from the ejecting outlet P2" than the edge P1"-2 of the opening P1" away from the ejecting outlet P2" by a distance D. Within the range from the set position on the side surface 13" to the first end surface 11", the side surface 13" of the electrode 10" is provided with an insulating coating layer T, and the entire first end surface 11" is provided with an insulating coating layer T.

In this way, the insulating property between the droplets and the electrode can be effectively improved, and the end portion 10"-1 of the electrode 10" protruding from the insulating base 20"-2 can be protected from the adverse effects of the external environment (e.g., moisture).

For example, the distance D is greater than or equal to 5 mm. In this way, the insulation between the droplets and the electrode can be further improved.

Referring to FIG. 8, the portion of the side surface 13" of the electrode 10" located between a set position W and the first end surface 11" in the X direction is entirely covered by the insulating coating layer T. In a second direction Y perpendicularly intersecting the first direction X (i.e., in the radial direction of the electrode 10"), the projection of the opening P1" on the electrode 10" is entirely located on the insulating coating layer T on the electrode 10".

For example, an edge of the insulating coating layer T away from the first end surface 11" in the X direction coincides with the set position W. A portion of the side surface 13" of the electrode 10" located at a side of the set position W away from the first end surface 11" in the X direction is exposed to the second fluid channel 22".

In another example, only a portion of the side surface 13" of the electrode 10" is provided with an insulating coating layer, and no insulating coating layer is provided on the first end surface 11" for example. In yet another example, a portion of the first end surface 11" of the electrode 10 "is provided with an insulating coating layer, while no insulating coating layer is provided on another portion of the first end surface 11". In this case, for example, in the second direction Y perpendicularly intersecting the first direction X (i.e., in the radial direction of the electrode 10"), the projection of the opening P1" on the electrode 10" is entirely located on the insulating coating layer of the electrode 10". Compared with a case where there is no insulating coating layer is arranged on the electrode 10", the insulating property between the droplets and the electrode can be correspondingly improved, and the end portions of the electrode can be protected from the adverse effects of the external environment (e.g., moisture).

The following statements should be noted:

(1) The accompanying drawings involve only the structure(s) in connection with the embodiment(s) of the present disclosure, and other structure(s) can be referred to common design(s).

(2) For the purpose of clarity only, in accompanying drawings for illustrating the embodiment(s) of the present disclosure, the thickness of a layer or area may be enlarged or narrowed, that is, the drawings are not drawn in a real scale.

(3) In case of no conflict, features in one embodiment or in different embodiments can be combined.

The above descriptions are only exemplary embodiments of the present disclosure, and are not intended to limit the protection scope of the present disclosure which is determined by the appended claims.

The invention claimed is:

1. A nozzle assembly, comprising:

an electrode with a strip shape extending in a first direction, wherein the electrode has a first end surface and a second end surface at two opposite ends in the first direction and a side surface connecting the first end surface and the second end surface; and an insulating body portion, arranged around the electrode along a circumferential direction around the first direction, and comprising an outer end surface close to the first end surface and an inner surface facing the side surface of the electrode, wherein a first fluid channel configured to transfer a first fluid is arranged in the insulating body portion, a first opening is formed on the inner surface of the insulating body portion by the first fluid channel, a second fluid channel configured to transfer a second fluid is arranged between the inner surface of the insulating body portion and the side surface of the electrode, an ejecting outlet is formed on the outer end surface of the insulating body portion by the second fluid channel, and the second fluid channel is communicated with the first fluid channel at the first opening, an interface channel is arranged in the insulating body portion to provide the second fluid to the second fluid channel, a second opening is formed on the inner surface of the insulating body portion by the interface channel, at least part of the second fluid channel is located between the first fluid channel and the electrode; and in the first direction, the first opening is located between the second opening and the ejection outlet.

2. The nozzle assembly according to claim 1, wherein the side surface of the electrode is a conductive surface, and at least part of the conductive surface is directly exposed to the second fluid channel.

3. The nozzle assembly according to claim 1, wherein at least part of each of the side surface and the first end surface of the electrode is provided with an insulating coating layer, and in a second direction perpendicularly intersecting the first direction, a projection of the first opening on the electrode is entirely located on the insulating coating layer of the electrode.

4. The nozzle assembly according to claim 3, wherein in the first direction, a set position on the side surface is farther away from the ejecting outlet than an edge of the first opening away from the ejecting outlet by at least 5 mm, and within a range from the set position on the side surface to the first end surface, the side surface of the electrode is provided with the insulating coating layer, and whole of the first end surface is provided with the insulating coating layer.

5. The nozzle assembly according to claim 1, wherein an end portion of the electrode connected with the first end surface has a cylindrical shape, and in the first direction, a length of the end portion is greater than a distance from the edge of the fit opening away from the ejecting outlet to the first end surface.

6. The nozzle assembly according to claim 5, wherein a diameter D1 of a projection of the end portion on a plane perpendicular to the first direction is in a range of 0.5 mm to 5 mm.

7. The nozzle assembly according to claim 5, wherein the inner surface of the insulating body portion comprises a first sub-inner surface located between the first opening and the ejecting outlet in the first direction and a second sub-inner surface which is on a side of the first opening away from the ejecting outlet and opposite to the end portion, both the first sub-inner surface and the second sub-inner surface are cylindrical surfaces, and the first sub-inner surface, the second sub-inner surface and the end portion are coaxially arranged.

8. The nozzle assembly according to claim 7, wherein a diameter D2 of the second sub-inner surface is greater than the diameter D1 of the first end surface by 1 mm to 5 mm.

9. The nozzle assembly according to claim 7, wherein a ratio of a diameter D3 of the first sub-inner surface to the diameter D2 of the second sub-inner surface is in a range of 1 to 1.3.

10. The nozzle assembly according to claim 5, wherein in the first direction, an edge of the first opening close to the ejecting outlet is no closer to the ejecting outlet than the first end surface of the electrode, and a distance between each position of the edge, close to the ejecting outlet, of the first opening and the first end surface of the electrode is constant and between 0 mm and 8 mm.

11. The nozzle assembly according to claim 5, wherein in a direction from the second end surface to the first end surface, a radial size of at least part of the electrode gradually shrinks, and the at least part of the electrode is directly connected with the end portion.

12. The nozzle assembly according to claim 1, wherein the insulating body portion comprises an insulating base and an insulating cover which are detachably connected with each other, the insulating base, the insulating cover and the electrode jointly define the second fluid channel, and the insulating base and the insulating cover jointly define the first fluid channel.

13. The nozzle assembly according to claim 12, wherein at least one sealing member is arranged between the insulating base and the insulating cover to prevent a fluid from the first fluid channel from leaking to the outside of the insulating body portion via a gap between the insulating base and the insulating cover.

14. The nozzle assembly according to claim 1, wherein the outer end surface of the insulating body portion is formed with a concave portion recessed toward the second end surface, the ejecting outlet is located at the bottom of the concave portion, and the first end surface of the electrode is located in the concave portion.

15. The nozzle assembly according to claim 1, wherein the first fluid channel and the second fluid channel each have an annular shape around the electrode.

16. The nozzle assembly according to claim 15, wherein the electrode, the first fluid channel and the second fluid channel are coaxially arranged.

17. An ejecting device, comprising:

the nozzle assembly of claim 1, a liquid source communicated with the first fluid channel and configured to supply a liquid as the first fluid to the first fluid channel;

a gas source communicated with the second fluid channel and configured to provide an insulating gas as the second fluid to the second fluid channel; and a power supply electrically connected to the electrode and configured to supply voltage to the electrode.

18. The ejecting device of claim 17, wherein an absolute value of the voltage is less than or equal to 1,300 V.

19. An ejecting method using a nozzle assembly, wherein the nozzle assembly is the nozzle assembly of claim 1, and the method comprises:

supplying a gas to the second fluid channel to form a gas flow in the second fluid channel;

supplying a liquid to the first fluid channel to form a liquid flow in the first fluid channel; and supplying a voltage of a first polarity to the electrode, so that droplets formed by meeting of the gas flow and the liquid flow are induced by the electrode and thus carry charges of a second polarity which is opposite to the first polarity.

20. The ejecting method according to claim 19, wherein the liquid flow is introduced into the first fluid channel and reaches the first opening in a state where the gas flow is introduced into the second fluid channel.

* * * * *